US008640830B2

(12) United States Patent
Look

(10) Patent No.: US 8,640,830 B2
(45) Date of Patent: Feb. 4, 2014

(54) HYDRAULIC SYSTEM FOR DOUBLE STACKER INDUSTRIAL TRUCK

(75) Inventor: Lena Look, Mantorp (SE)

(73) Assignee: BT Products AB, Mjolby (SE)

( * ) Notice: Subject to any disclaimer, the term of this patent is extended or adjusted under 35 U.S.C. 154(b) by 290 days.

(21) Appl. No.: 13/059,248

(22) PCT Filed: Aug. 18, 2009

(86) PCT No.: PCT/EP2009/060679
§ 371 (c)(1),
(2), (4) Date: Feb. 16, 2011

(87) PCT Pub. No.: WO2010/023131
PCT Pub. Date: Mar. 4, 2010

(65) Prior Publication Data

US 2011/0139546 A1 Jun. 16, 2011

(30) Foreign Application Priority Data

Aug. 27, 2008 (EP) ..... 08163068

(51) Int. Cl.
*B66F 9/22* (2006.01)

(52) U.S. Cl.
USPC ..... 187/275

(58) Field of Classification Search
CPC ..... B66F 9/22; B66F 9/085
USPC ..... 187/275; 137/299.11, 601.14
See application file for complete search history.

(56) References Cited

U.S. PATENT DOCUMENTS

| | | | | |
|---|---|---|---|---|
| 3,495,610 A * | 2/1970 | Van Aken, Jr. | ..... | 137/99 |
| 4,395,189 A | 7/1983 | Munten | | |
| 5,447,094 A * | 9/1995 | Geyler, Jr. | ..... | 91/520 |
| 6,389,953 B1 * | 5/2002 | Altman et al. | ..... | 91/515 |

FOREIGN PATENT DOCUMENTS

| | | | | |
|---|---|---|---|---|
| DE | 40 23 092 A1 | 1/1992 | | |
| EP | 1593645 A2 * | 11/2005 | ..... | B66F 9/22 |
| JP | 52 011561 A | 1/1977 | | |
| JP | 02 018298 A | 1/1990 | | |

OTHER PUBLICATIONS

International Search Report corresponding to PCT/EP2009/060679 mailed Nov. 30, 2009.
Written Opinion of the International Searching Authority corresponding to PCT/EP2009/060679 mailed Nov. 30, 2009.
International Preliminary Report on Patentability corresponding to PCT/EP2009/060679 mailed Nov. 11, 2010.
"Polaris Gear Flow Dividers" Announcement Casappa, Casappa, Parma, IT, Nov. 2, 2000, pp. 1, 10-14, 19 A/B, XP001223970 p. 11.

* cited by examiner

*Primary Examiner* — William E Dondero
*Assistant Examiner* — Diem Tran
(74) *Attorney, Agent, or Firm* — Renner, Otto, Boisselle & Sklar, LLP

(57) ABSTRACT

The invention relates to hydraulic system for an double stacker truck comprising a pump for providing hydraulic fluid to the hydraulic system and a first hydraulic lifting cylinder for moving a first load carriage and a second hydraulic lifting cylinder for moving a second load carriage of the truck, the hydraulic lifting system is characterized in a flow divider for dividing the flow of hydraulic fluid between the first and the second hydraulic cylinder and a first directional valve which is arranged open in a first direction for leading hydraulic fluid to the first lifting cylinder or to open in a second direction for leading hydraulic fluid to the second hydraulic cylinder. The invention also relates to a double stacker truck comprising a hydraulic system for moving the load carriages of the truck.

12 Claims, 4 Drawing Sheets

HYDRAULIC SYSTEM FOR DOUBLE STACKER INDUSTRIAL TRUCK

This application is a national phase of International Application No. PCT/EP2009/060679 filed Aug. 18, 2009 and published in the English language.

TECHNICAL FIELD

The present invention relates to a hydraulic system for a double stacker industrial truck. The invention also relates to a double stacker truck comprising a hydraulic system for moving the load carriages of the truck.

BACKGROUND ART

In warehouses, goods are normally unloaded and placed into pallet racks until needed for selling or further processing. When an order arrives, a stacker, or staple, truck is sent out to pick up the goods and deliver them for further transport or processing. The handling of goods in this way is very labor intensive, since every delivery and pick up order demands the operation of one truck and one driver.

In order to increase the operation efficiency of goods handling in warehouses, industrial trucks with double loading capacity have been developed. Such industrial trucks, generally known as double staple or stacker trucks, are provided with two pair of forks. In operation, the truck loads one pallet on the first forks and raises the pallet on the mast. Thereafter another pallet may be loaded on the second forks. The two pallets may thereafter be transported to a loading/unloading platform. A double stacker industrial truck according to the preamble of claim 1 is described in DE 20 2005 015 354 U1. In this known truck, both load carriages are arranged on the same mast and are driven separately in the vertical direction.

One problem with such a construction is that when both load carriers are moved on the mast, only the load carrier with the lowest hydraulic pressure will move. The difference in hydraulic pressure is normally caused by variations in load or friction between the load carriages and the mast and could cause the loads to collide on the mast. The separate drives of the load carriers also makes it difficult to equally divide the lifting work between the load carriers when both carriers are used to lift one single load.

It is an object of the present invention to provide a hydraulic system for a double stacker industrial truck which solves the aforementioned problem. A further object is to provide a hydraulic system which provides greater flexibility between different lifting operations. A further object is to provide a double stacker industrial truck comprising a hydraulic system which solves the aforementioned problem. Yet a further object is to provide a double stacker industrial truck which provides greater flexibility between different lifting operations.

SUMMARY OF THE INVENTION

At least one of the aforementioned object is achieved by a hydraulic system for an double stacker truck comprising a pump for providing hydraulic fluid to the hydraulic system and a first hydraulic lifting cylinder for moving a first load carriage and a second hydraulic lifting cylinder for moving a second load carriage of the truck, the hydraulic lifting system is characterized in a flow divider for dividing the flow of hydraulic fluid between the first and the second hydraulic cylinder and a first directional valve which is arranged open in a first direction for leading hydraulic fluid to the first lifting cylinder or to open in a second direction for leading hydraulic fluid to the second hydraulic cylinder.

The hydraulic system according to the invention provides for different lifting operations. One of the lifting operations is the lifting of two separate loads, one load on the first load carriage and one load on the second load carriage. Another lifting operation is the lifting of one single load simultaneously with both the first and the second load carriage. The specific arrangement of the flow divider and the direction valve ensures that the load carriages in each case move with the same velocity, regardless of external factors such as different load weights or friction between load carriages and masts. Thereby is achieved that, in the first lifting operation, collision between the upper and the lower load is prevented. In the second lifting operation is achieved that a single load readily may be lifted since both load carriers perform an equal amount of lifting work.

The hydraulic system may comprise a second directional valve which is arranged to open in a first direction for leading hydraulic fluid to the second lifting cylinder or to open in a second direction for leading fluid to the first lifting cylinder. Thereby, it is possible to separately move each of the two load carriages, or to simultaneously move both load carriages.

The flow divider may be arranged to divide the flow of hydraulic fluid between the first and the second cylinder according to the ratio of the total area of the first cylinder to the total area of the second cylinder, so that the velocity of the first load carriage is equal to the velocity of the second load carriage.

Alternatively, the flow divider may be arranged to divide the flow of hydraulic fluid between the first and the second cylinder according to the ratio of the total area of the first cylinder to the total area of the second cylinder times a gearing factor, so that the velocity of the first load carriage is equal to the velocity of the second carriage.

Alternatively, the flow divider may be arranged to divide the flow of hydraulic fluid between the first and the second cylinder according to the ratio of the total area of the first cylinder times a gearing factor to the total area of the second cylinder, so that the velocity of the first load carriage is equal to the velocity of the second load carriage.

The cylinder area of the first hydraulic cylinder may be equal to the cylinder area of the second hydraulic cylinder.

Alternatively, the cylinder area of the first cylinder may be different from the cylinder area of the second cylinder.

According to one alternative, the flow divider could be a motor-type flow divider. Such a flow divider provides for good energy efficiency in the hydraulic system.

According to another alternative, the flow divider could be a valve-type flow divider. This type of flow divider equalizes the flow of the hydraulic fluid differences very fast.

The hydraulic system has an outlet for return fluid, which may comprise an on/off valve and a flow control valve, or a proportional valve. Thereby, the load carriages may be lowered in a controlled manner.

The hydraulic system may comprise a check valve arranged between the pump and the flow divider, thereby preventing fluid from flowing back into the pump.

The hydraulic system may comprise a pressure relief valve, arranged between the pump and the check valve. Whereby, excessive pressure is prevented in the hydraulic system.

The invention further relates to a double stacker truck comprising first and second masts and first and second load carriages and a hydraulic system according to any of the above described alternatives.

DETAILED DESCRIPTION

Figure 1:
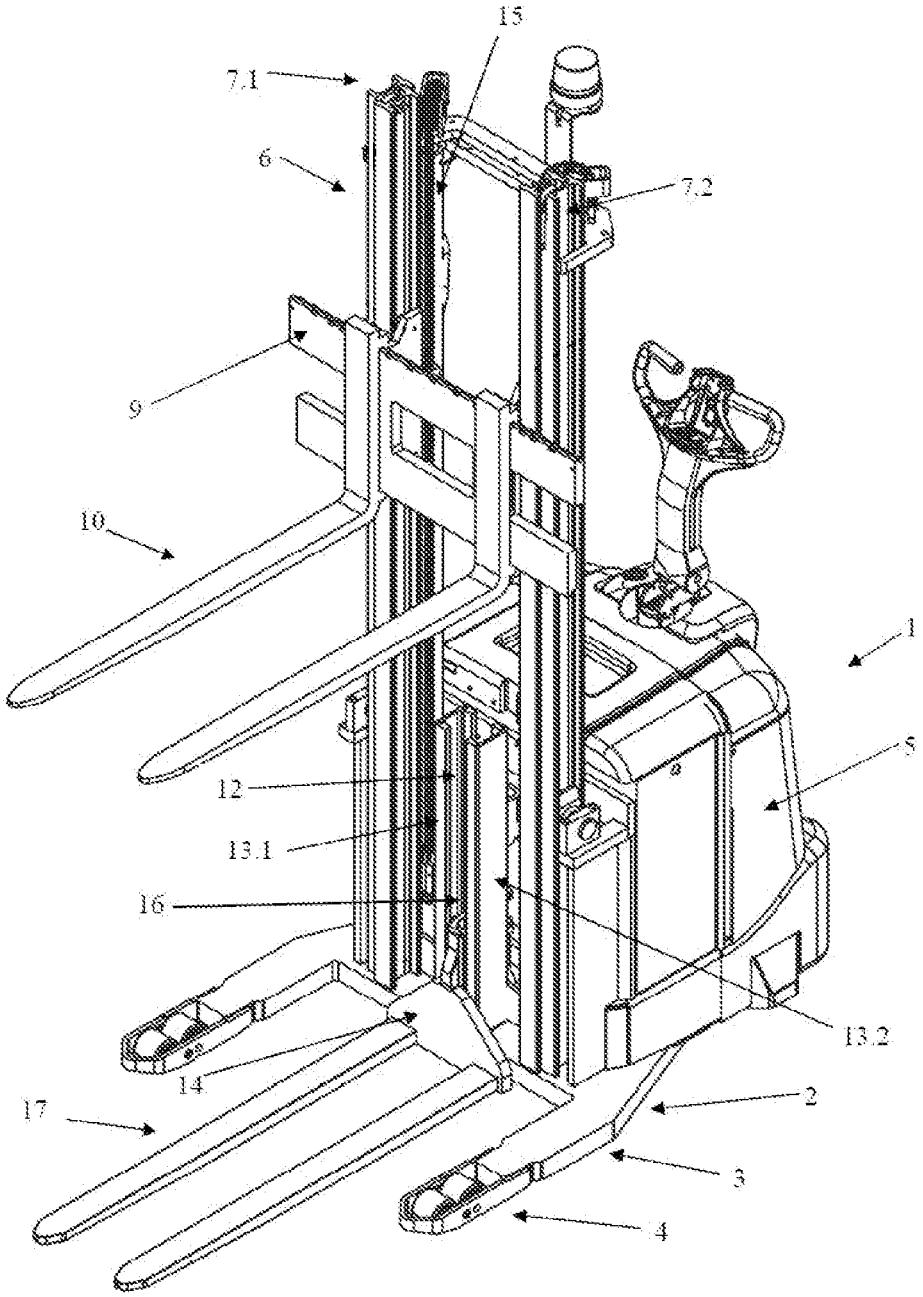
FIG. 1 schematically illustrates a double stacker, industrial truck comprising a hydraulic system according to the invention.

FIG. 1 describes a double stacker industrial truck 1 comprising a hydraulic system according to the invention. The truck could be any type of industrial truck, for example a fork lift truck or a reach truck.

The industrial truck 1 comprises a frame 2. The forward part of the frame 2 extends into two support arms 3 on which support wheels 4 are arranged. The rear part of the frame supports a motor housing 5 in which an electrical motor (not shown) and parts of a hydraulic system are accommodated (not shown). A drive wheel driven by the electrical motor is arranged under the frame. The hydraulic system powers the raising and lowering of the load carriages of the truck, as explained further below. The truck also comprises a space for the driver, such as a seat or a platform, as well as means for steering the truck e.g. a steering handle or a steering wheel.

The truck further comprises a first lifting mast 6 comprising a pair of uprights 7.1, 7.2. Normally, the first mast is arranged on a forward part of the frame, in front of the motor housing. A load carriage 9 is journalled in the uprights of the mast. The load carriage 9 is arranged to be raised and lowered by a first hydraulic cylinder 15, normally by the actuation of a chain and pulley system in known manner. Obviously, the first mast could also be a telescopic mast. The industrial truck further comprises a second mast 12. The second mast 12 is arranged between the uprights of the first mast 6 on a forward part of the frame 2, in front of the motor housing 5. Normally, the second mast 12 comprises two uprights 13.1, 13.2, for example in the form of U-shaped beams. Each beam may be supported on its butt end on the frame 2 and fixed to the motor housing with its legs turned against each other. A second load carriage 14 is journalled in the second mast 12. Load carriage 14 is arranged to be raised and lowered by means of a second hydraulic cylinder 16.

Normally, load engaging means, such as forks 10, 17 are provided on each load carriage.

Figure 2:
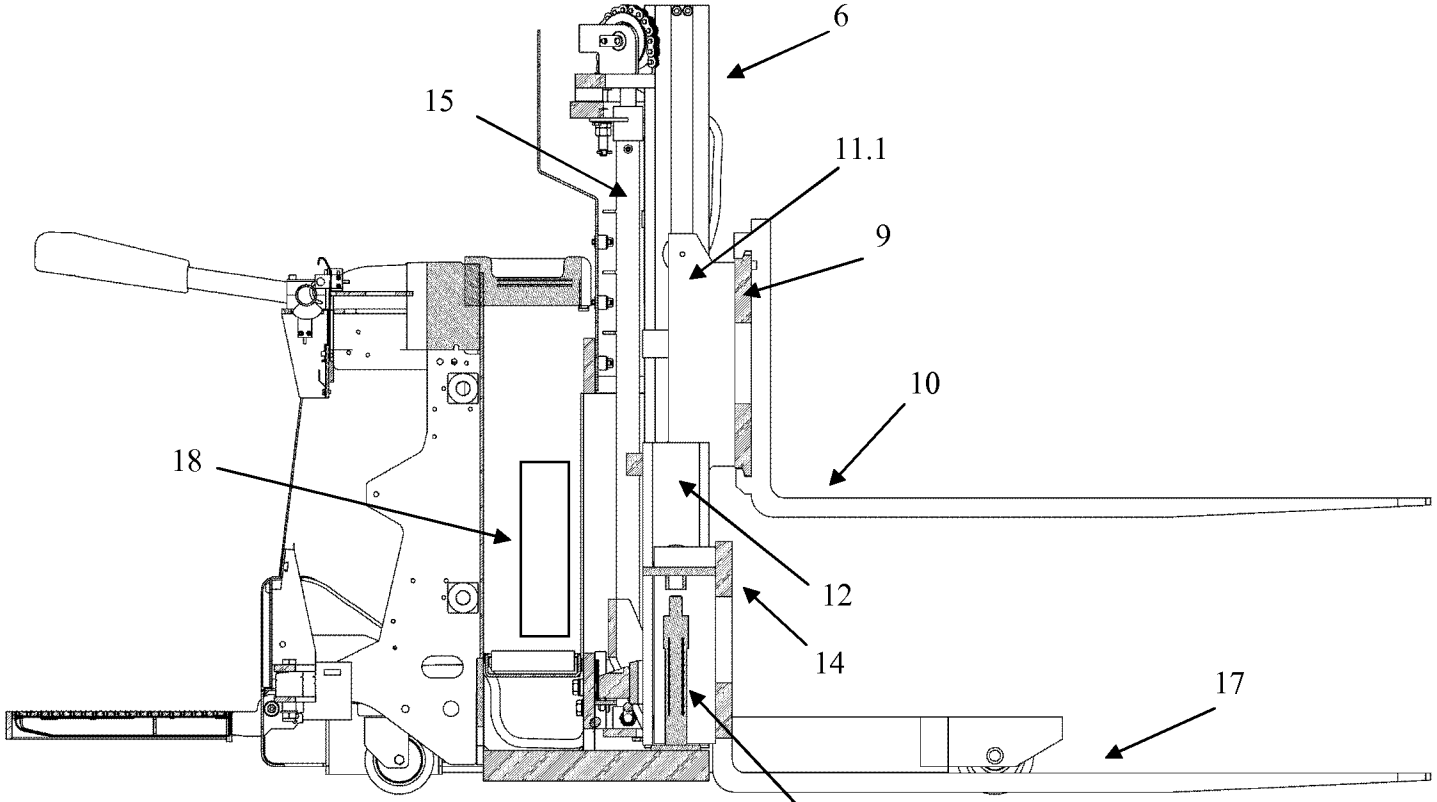
FIG. 2 is a longitudinal cross section of the industrial truck shown in FIG. 1.

FIG. 2 illustrates a longitudinal cross-section of the industrial truck illustrated in FIG. 1. FIG. 2 show the positions of the first hydraulic cylinder 15 and the second hydraulic cylinders 16 that are comprised in the hydraulic system 18. The other parts of the hydraulic system 18 are located in the motor housing 5 and connected to the hydraulic cylinders. FIG. 2 further shows a part of the first mast 6, the second mast 12, the first load carriage 9 and the second load carriage 14 and the load engagement means 10 and 17.

Figure 3:
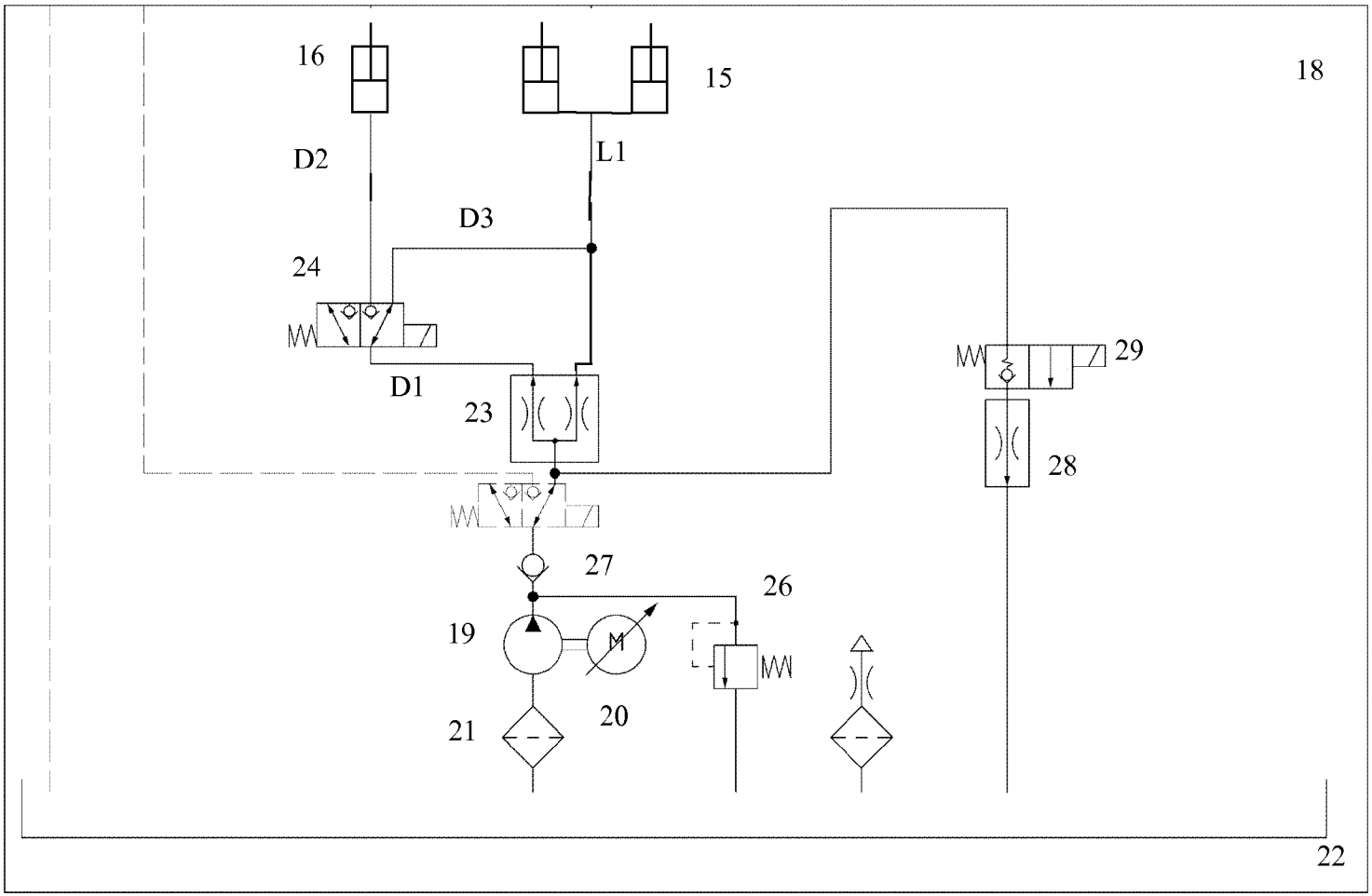
FIG. 3 schematically illustrates a first embodiment of the hydraulic system according to the invention.

FIG. 3 illustrates the hydraulic system 18 of a double stacker truck according to the invention. The hydraulic system comprises a first hydraulic cylinder 15 for rising or lowering the first load carriage on the first mast and a second hydraulic cylinder 16 for rising or lowering the second load carriage on the second mast. It is obvious that the first and/or the second lifting cylinder could also consist of two or more hydraulic cylinders connected parallel as indicated in FIG. 3. In the simplest form, the total cylinder area of the first lifting cylinder/s 15 is equal to the total cylinder area of the second lifting cylinder/s 16. However, the total area of the first cylinder may be different from the total area of the second cylinder due to constructional design of the lifting masts or pressure optimizing of the lifting cylinders. Thus, the total area of the first hydraulic cylinder could be either larger or smaller than the total area of the second cylinder.

The system also comprises a pump 19 for supplying hydraulic fluid to the system. The pump is connected to an electrical motor 20 and to a tank 22 over a filter 21.

The flow of hydraulic fluid from the pump to the first and the second lifting cylinder is regulated by a flow divider 23 and a directional valve 24, such as a solenoid valve. The flow divider has two outlets and is typically a valve-type flow divider or a motor type flow divider The flow divider 23 divides the flow of hydraulic fluid from the pump between the first and second lifting cylinder in a predetermined ratio, so that the first and the second load carriage has the same velocity when moved simultaneous on each mast.

If a back pressure start to build up on one outlet of the flow divider for example due to differences in weight on the load carriages or friction between mast and load carriage this could cause more fluid to flow towards the low pressure side of the flow divider. This, in turn causes more fluid to exit there causing the hydraulic cylinders to move with different velocities. In the fluid divider this is prevented in that the flow divider reduces the flow on the low pressure side so that the predetermined flow ratio is maintained between the outlets. Thereby, equal velocity of the cylinders is ensured.

The ratio of the fluid flow from the outlets of the flow divider should match the ratio of the total area of the first and the second cylinder. For example, if the total area of the first cylinder is equal to the total area of the second cylinder, the flow to each cylinder should be equal. If the area of the first cylinder is twice as large as the area of the second cylinder, the flow divider should divide the flow so that twice as much flow is directed to the first cylinder, thus the flow ratio can be described by the expression:

$$\text{Flow ratio} = \frac{\text{Flow to 1:st cylinder}}{\text{Flow to 2:nd cylinder}} = \frac{\text{Area of 1:st cylinder}}{\text{Area of 2:nd cylinder}}$$

In some cases one or both lifting cylinders may be arranged to raise and lower the load carrier over a gearing system e.g. a chain and pulley system. The gearing system transforms a small displacement of the lifting cylinder into a larger movement of the load carrier on the mast. The increase of movement is referred to as "gearing factor" and is normally 2 times the displacement of the lifting cylinder, however the gearing factor could also be greater or smaller than that. In order to achieve equal velocity of the first and second load carrier the gearing factor has to be considered in the determination of the flow ratio. For example, if the total area of the cylinders is equal and the first cylinder is arranged to lift a load carrier over a gearing system with a gearing factor of 2, the flow of hydraulic fluid to the second cylinder has to be twice as large as the fluid flow to the first cylinder in order to achieve equal velocity of the load carriers. In this case the flow ratio could be expressed as:

$$\text{Flow ratio} = \frac{\text{Flow to 1:st cylinder}}{\text{Flow to 2:nd cylinder}} = \frac{\text{Area of 1:st cylinder}}{\text{Area of 2:nd cylinder} * \text{gearing factor}}$$

The inlet of the flow divider 23 is connected to the pump 19. The first outlet of the flow divider is connected to the first lifting cylinder 15 by a duct L1. The second outlet is connected to the directional valve 24 by a duct D1. Valve 24 is connected to the second hydraulic cylinder 16 by a duct D2 and by a duct D3 to the first hydraulic cylinder 15. The directional valve 24 is arranged to open in two distinct directions, however only one direction may be open at a time. When valve 24 is open in the first direction, fluid is lead from the second outlet of the flow divider through duct D2 to hydraulic cylinder 16. When valve 24 is open in the second direction, fluid is lead through duct D3, to duct L2 and further to hydraulic cylinder 15.

The hydraulic system 18 further comprises an outlet for draining fluid from the system, e.g. during lowering of the load carriages. The outlet is connected on the inlet line to the flow divider and comprises an on/off valve 29 and a flow control valve 28 arranged in series. These valves could also be substituted with a proportional valve, for example a pressure compensated proportional valve. A check valve 27 is arranged between the pump 19 and the flow divider 23, the check valve ensures that fluid does not drain back into the pump. Between check valve 27 and the pump 19 is a pressure relief valve 26 connected. The purpose of the relief valve 26 is to release excessive pressure from the hydraulic system, if such pressure should build up.

Figure 4:
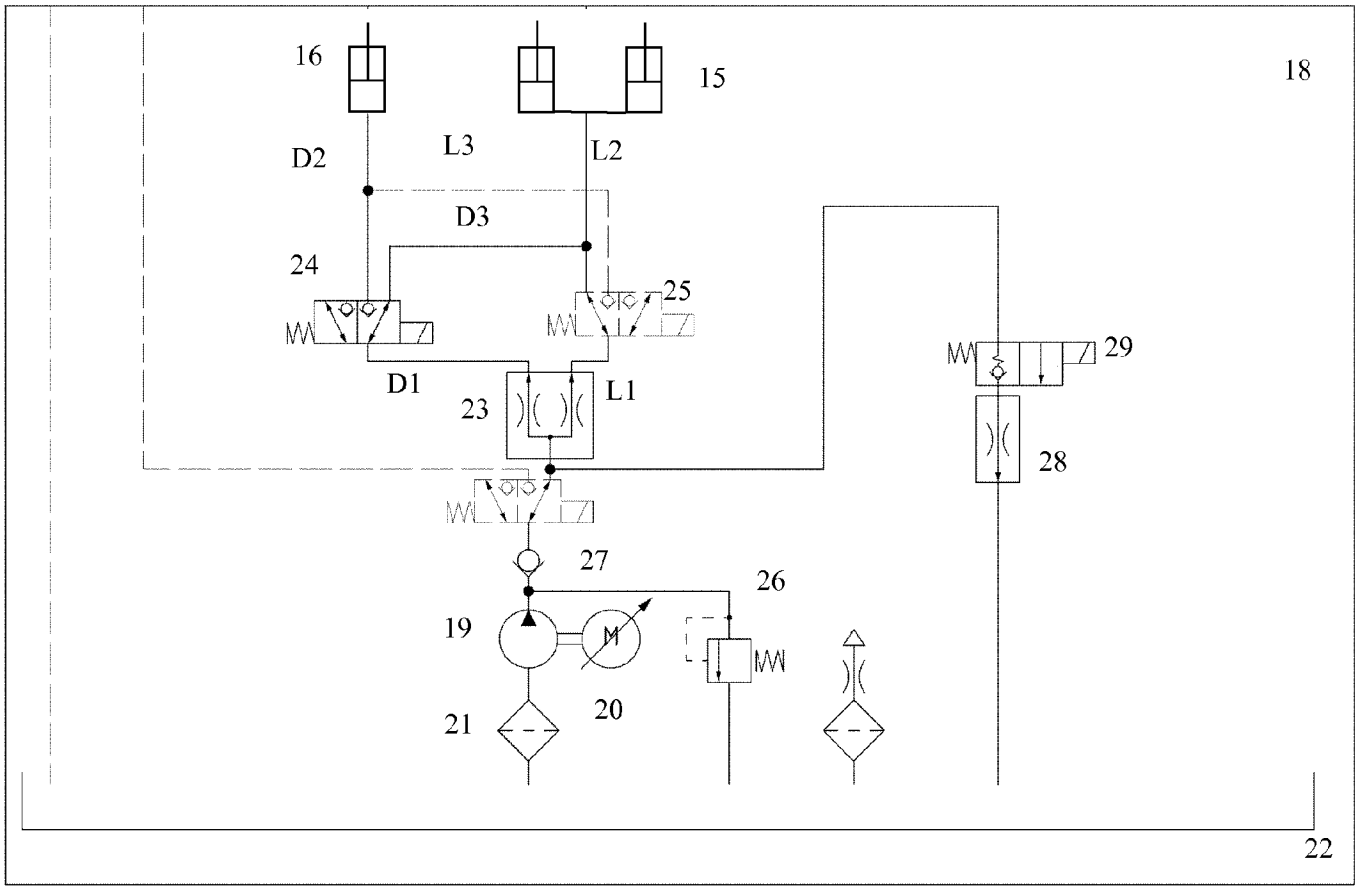
FIG. 4 schematically illustrates a second embodiment of the hydraulic system according to the invention.

As described in FIG. 4 the hydraulic system according to a second embodiment of the invention may also comprise two directional valves 24 and 25. The first direction valve 24 is connected to the second outlet of the flow divider by a duct D1 and to the second lifting cylinder 16 by a duct D2. The second direction valve 25 is connected to the first outlet of the flow divider by a duct L1 and to the first lifting cylinder 15 by a duct L2. The first directional valve 24 is further connected by a duct D3 to duct L2. The second directional valve 25 is further connected by a duct L3 to duct D2.

Each directional control valve is arranged to open in two distinct directions, however only one direction may be open at a time. When valve 24 is open in the first direction, fluid is lead from through duct D2 to hydraulic cylinder 16. When valve 24 is open in the second direction, fluid is lead through duct D3, to duct L2 and further to hydraulic cylinder 15. When valve 25 is open in the first direction, fluid is lead through duct L2 to hydraulic cylinder 15. When valve 25 is open in the second direction, fluid is lead through duct L3, to duct D2 and further to hydraulic cylinder 16. The arrangement of two directional valves makes it possible to move each of the load carriages separately or to simultaneous move both load carriages.

USE OF THE INVENTION

Following is a description of the use of the hydraulic system according to the invention.

According to a first alternative, two separate loads are lifted, one load on a first set of forks and one load on the second set of forks.

At the beginning of the lifting operation the first and the second load engagement means, normally forks, are in a start position at the same distance above the floor, generally 35 mm above the floor. Both forks are simultaneously inserted in the corresponding grooves of a first pallet which supports a first load. Direction valve 24 is opened so that fluid may be directed through duct D3 to cylinder 15.

Next, the pump 19 is started. The fluid flow from the pump is divided according to a predetermined ratio in flow divider 23 and conducted to the first hydraulic cylinder 15 through duct L1 and, over valve 24, through duct D3, whereby the first load is raised on the first mast 6. When the load is raised a sufficient distance on the first mast the pump is stopped. The second forks 17 are then inserted in the corresponding grooves of a second pallet. Valve 24 is now opened so that fluid may be directed from the second outlet of the flow divider through duct D2 to the hydraulic cylinder 16. The pump is started again. The fluid divider 23 divides the fluid between the first and second lifting cylinders whereby the first and second loads are raised on respective mast. When the second load is raised sufficiently the pump is stopped.

Lowering is performed by the opening of the draining outlet by actuating the on/off-valve 29. The lowering speed may be controlled by flow control valve 28.

According to a second alternative, both load carriers are used to lift a single load. At the beginning of the lifting operation both sets of forks, are in a start position at the same distance above the floor, generally 35 mm above the floor. Both forks are inserted in the corresponding grooves of a pallet on which the load is placed.

The valve 24 is opened so that fluid may be directed through duct D2 to the hydraulic cylinder 16. The pump is started and the fluid is divided according to a predetermined ratio between the two lifting cylinders by the flow divider 23. Due to the opening configuration of valve 24, both cylinders move parallel upwards and lift the load simultaneously. Lowering of the load is performed by opening of the draining outlet by actuating the on/off-valve 29.

Although particular descriptions of the hydraulic system have been disclosed herein in detail, this has been done for purposes of illustration only, and is not intended to be limiting with respect to the appended claims. In particular, it is contemplated by the inventor that various substitutions, alterations, and modifications may be made to the invention within the scope of the appended claims. For example, the hydraulic system could be arranged to move two load carriages arranged on a single mast truck. The hydraulic system could further comprise parts for additional hydraulic functions, such as side shifting and fork spreader.

The invention claimed is:

1. A double stacker industrial truck comprising:

a first mast and a second mast;

a first load carriage and a second load carriage; and a hydraulic system comprising:

a pump for providing hydraulic fluid to the hydraulic system;

a first hydraulic lifting cylinder for moving the first load carriage and a second hydraulic lifting cylinder for moving the second load carriage of the truck; and a flow divider having an inlet, a first outlet, and a second outlet for dividing a flow of hydraulic fluid between the first hydraulic lifting cylinder and the second hydraulic lifting cylinder, wherein:

a first directional valve is connected to the second outlet of the flow divider by a duct (D1), said first directional valve is connected to the second hydraulic lifting cylinder by a duct (D2), and said first directional valve is connected to the first hydraulic lifting cylinder by a duct (D3);

the first directional valve is arranged to open in a first direction for leading hydraulic fluid through duct (D2) to the second hydraulic lifting cylinder or to open in a second direction for leading hydraulic fluid through duct (D3) to the first hydraulic lifting cylinder.

2. The double stacker industrial truck according to claim 1, comprising a second directional valve connected to the first outlet of the flow divider by a duct (L1), said second directional valve is connected to the first hydraulic lifting cylinder by a duct (L2), and said second directional valve is connected to the second hydraulic lifting cylinder by a duct (L3), wherein the second directional valve is arranged to open in a first direction for leading hydraulic fluid through duct (L2) to the first hydraulic lifting cylinder or to open in a second direction for leading hydraulic fluid through duct (L3) to the second hydraulic lifting cylinder.

3. The double stacker industrial truck according to claim 1, wherein the flow divider is arranged to divide the flow of hydraulic fluid between the first hydraulic lifting cylinder and the second hydraulic lifting cylinder according to a ratio of a total area of the first hydraulic lifting cylinder to a total area of the second hydraulic lifting cylinder, so that a velocity of the first load carriage is equal to a velocity of the second load carriage.

4. The double stacker industrial truck according to claim 1, wherein the flow divider is arranged to divide the flow of hydraulic fluid between the first hydraulic lifting cylinder and the second hydraulic lifting cylinder according to a ratio of a total area of the first hydraulic lifting cylinder to a total area of the second hydraulic lifting cylinder times a gearing factor, so that a velocity of the first load carriage is equal to a velocity of the second load carriage.

5. The double stacker industrial truck according to claim 1, wherein the flow divider is arranged to divide the flow of hydraulic fluid between the first hydraulic lifting cylinder and the second hydraulic lifting cylinder according to a ratio of a total area of the first hydraulic lifting cylinder times a gearing factor to a total area of the second hydraulic lifting cylinder, so that a velocity of the first load carriage is equal to a velocity of the second load carriage.

6. The double stacker industrial truck according to claim 1, wherein a total area of the first hydraulic lifting cylinder is equal to a total area of the second hydraulic lifting cylinder.

7. The double stacker industrial truck according to claim 1, wherein a total area of the first hydraulic lifting cylinder is different from a total area of the second hydraulic lifting cylinder.

8. The double stacker industrial truck according to claim 1, wherein the flow divider is a motor-type flow divider.

9. The double stacker industrial truck according to claim 1, wherein the flow divider is a valve-type flow divider.

10. The double stacker industrial truck according to claim 1, further comprising an outlet for return fluid, the outlet comprising an on/off valve and a flow control valve or a proportional valve.

11. The double stacker industrial truck according to claim 1, further comprising a check valve arranged between a pump and the flow divider.

12. The double stacker industrial truck according to claim 11, further comprising a pressure relief valve arranged between the pump and the check valve.

* * * * *